US010446930B1

(12) United States Patent
Gommé et al.

(10) Patent No.: US 10,446,930 B1
(45) Date of Patent: Oct. 15, 2019

(54) ANTENNA COMBINATION DEVICE

(71) Applicant: NXP B.V., Eindhoven (NL)

(72) Inventors: Liesbeth Gommé, Anderlecht (BE); Anthony Kerselaers, Herselt (BE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 16/016,915

(22) Filed: Jun. 25, 2018

(51) Int. Cl.

| | |
|---|---|
| ***H01Q 3/38*** | (2006.01) |
| ***H01Q 1/27*** | (2006.01) |
| ***H01Q 1/24*** | (2006.01) |
| ***H01Q 1/32*** | (2006.01) |
| ***H01Q 15/00*** | (2006.01) |

(52) U.S. Cl.
CPC ..... *H01Q 3/38* (2013.01); *H01Q 15/0053* (2013.01); *H01Q 1/243* (2013.01); *H01Q 1/273* (2013.01); *H01Q 1/32* (2013.01)

(58) Field of Classification Search
CPC ..... H01Q 3/38; H01Q 15/0053
USPC ..... 343/702, 700 MS; 342/368, 174, 374, 342/373
See application file for complete search history.

(56) References Cited

U.S. PATENT DOCUMENTS 5,657,023 A * 8/1997 Lewis ..... H01Q 3/2652 342/174
5,924,020 A 7/1999 Forssen et al.
6,046,697 A 4/2000 Overbury et al.
6,473,362 B1 * 10/2002 Gabbay ..... H01Q 3/26 367/119
6,549,164 B2 * 4/2003 Paschen ..... H01Q 3/267 342/371
6,624,784 B1 * 9/2003 Yamaguchi ..... H01Q 3/2605 342/372
6,700,542 B2 * 3/2004 Borlez ..... G01S 13/56 343/700 MS
6,747,595 B2 * 6/2004 Hirabe ..... H01Q 3/267 342/174
6,917,833 B2 * 7/2005 Denker ..... A61N 1/3787 128/903
6,975,178 B1 * 12/2005 Kessler ..... H01P 1/10 333/105

(Continued)

FOREIGN PATENT DOCUMENTS

CA 2 699 752 A1 4/2009

OTHER PUBLICATIONS

Wikipedia; "Phased array"; retrieved from the internet https://en.wikipedia.org/wiki/Phased_array; 12 pages (Feb. 6, 2018).

*Primary Examiner* — Lam T Mai

(57) ABSTRACT

One example discloses an antenna combination device, comprising: a modulation unit; wherein the modulation unit is configured to be coupled to: a first antenna, having a first set of electromagnetic field lobes and configured to pass a first signal; a second antenna, having a second set of electromagnetic field lobes and configured to pass a second signal; wherein the modulation unit is configured to vary the first signal and the second signal, resulting in a third set of electromagnetic field lobes from a combination of the first and second sets of electromagnetic field lobes; wherein the first, second and third electromagnetic field lobes are in a same plane; and wherein a number of the third set of lobes is less than or equal to either a number of the first set of lobes or a number of the second set of lobes.

20 Claims, 9 Drawing Sheets

(56) References Cited

U.S. PATENT DOCUMENTS

| | | | | |
|---|---|---|---|---|
| 7,379,515 | B2 * | 5/2008 | Johnson | H03D 7/00 375/347 |
| 7,414,577 | B2 * | 8/2008 | Mohamadi | H01Q 3/22 342/372 |
| 7,545,321 | B2 | 6/2009 | Kawasaki | |
| 9,071,253 | B2 * | 6/2015 | Li | H03B 1/00 |
| 2009/0160638 | A1 * | 6/2009 | Jesme | G01S 13/825 340/539.11 |
| 2016/0036125 | A1 | 2/2016 | Gupta et al. | |
| 2016/0064829 | A1 * | 3/2016 | Schaepperle | H01Q 9/0435 343/893 |

* cited by examiner

ANTENNA COMBINATION DEVICE

The present specification relates to systems, methods, apparatuses, devices, articles of manufacture and instructions for transmitting and/or receiving from a set of combined antennas.

SUMMARY

According to an example embodiment, an antenna combination device, comprising:

a modulation unit;

wherein the modulation unit is configured to be coupled to:

a first antenna, having a first set of electromagnetic field lobes and configured to pass a first signal;

a second antenna, having a second set of electromagnetic field lobes and configured to pass a second signal;

wherein the modulation unit is configured to vary the first signal and the second signal, resulting in a third set of electromagnetic field lobes from a combination of the first and second sets of electromagnetic field lobes;

wherein the first, second and third electromagnetic field lobes are in a same plane; and wherein a number of the third set of lobes is less than or equal to either a number of the first set of lobes or a number of the second set of lobes.

In another example embodiment, wherein at least one of the respective first and second sets of lobes of the first and second antennas is not an omnidirectional lobe.

In another example embodiment, wherein the third set of lobes are distributed over at least 180 arc degrees.

In another example embodiment, wherein the third set of lobes are distributed over at least 270 arc degrees.

In another example embodiment, wherein the third set of lobes includes a null;

wherein the modulation unit is configured to identify an interference source; and wherein the modulation unit is configured to select the first signal and the second signal, such that the null is oriented toward the interference source.

In another example embodiment, wherein the modulation unit is configured to receive information corresponding to a location of the interference source and a current location of the set of networked antennas; and wherein the modulation unit is configured to pre-orient the null toward the interference source before signals from the interference source are detected by the modulation unit.

In another example embodiment, wherein the third set of lobes has a quasi-omnidirectional composite antenna pattern.

In another example embodiment, wherein the third set of lobes has a composite antenna pattern in the plane that differs from an omnidirectional antenna pattern by a predetermined standard deviation.

In another example embodiment, wherein the standard deviation is at least 4 dB.

In another example embodiment, wherein the antenna combination device is embedded in at least one of: a vehicle, a pair of earbuds, or a smartphone.

In another example embodiment, wherein the first and second antennas are V2X antennas on a vehicle;

wherein the first antenna is a directional antenna oriented toward a front of the vehicle; and wherein the second antenna is a directional antenna oriented toward a back of the vehicle.

In another example embodiment, wherein the first signal of the first antennal includes a first amplitude and a first phase;

wherein the second signal of the second antennal includes a second amplitude and a second phase; and wherein the modulation unit includes:

an amplitude modulation unit; and a phase modulation unit;

wherein the amplitude and phase modulation units are configured to be coupled to the first and second antennas;

wherein the amplitude modulation unit is configured to vary a difference between the first amplitude of the first signal and the second amplitude of the second signal; and wherein the phase modulation unit is configured to vary a difference between the first phase of the first signal and the second phase of the second signal.

In another example embodiment, wherein the modulation unit is configured to obtain a set of individual and combined antenna E-field patterns for the first and second antennas; and wherein the first and second amplitudes are kept equal as a difference between the first and second phase is varied from 0 to 360 degrees.

In another example embodiment, wherein the modulation unit is configured to obtain a set of calibration factors based on the set of individual and combined E-field patterns.

In another example embodiment, wherein the modulation unit is configured to generate a new combined antenna E-field pattern based on the set of calibration factors and the individual antenna E-field patterns.

In another example embodiment, further comprising:

the first antenna and the second antenna coupled to the modulation unit; and a transceiver coupled to the modulation unit;

wherein the transceiver includes transmitter and/or receiver circuitry for generating and/or receiving the first and second signals.

According to an example embodiment, an article of manufacture including at least one non-transitory, tangible machine readable storage medium containing executable machine instructions for antenna combination when executed by a processor, comprising:

wherein the article includes, a modulation unit configured to be coupled to a first antenna and a second antenna;

wherein the first antenna, includes a first set of lobes and is configured to pass a first signal;

wherein the second antenna, includes a second set of lobes and is configured to pass a second signal; and wherein the instructions include, selecting a new third set of lobes;

wherein a number of the third set of lobes is less than or equal to either a number of the first set of lobes or a number of the second set of lobes;

calculating a first new signal having a first new amplitude and a first new phase, and a second new signal having a second new amplitude and a second new phase, based on the new third set of lobes, a first and second set of lobes, and a calibration factor stored in memory;

applying the first new signal to the first antenna, and the second new signal to the second antenna, such that the new third set of lobes is generated.

In another example embodiment, wherein the calibration factors were previously calculated by:

obtaining the first set of lobes by driving the first antenna by the first signal having a first amplitude and a first phase;

obtaining the second set of lobes by driving the second antenna by the first signal having the first amplitude and the first phase;

obtaining a default third set of lobes by driving both the first antenna and the second antenna by the first signal having the first amplitude and the first phase;

calculating a calibration factor based on the first set of lobes, the second set of lobes, and the default third set of lobes;

storing the first and second antenna patterns and the calibration factor in memory;

incrementing the first phase to a second phase;

repeating the obtaining, calculating, and storing for a second signal having the first amplitude and the second phase; and repeating the incrementing, obtaining, calculating, and storing for an additional set of phases, while keeping the first amplitude.

In another example embodiment, wherein the calibration factors were previously calculated according to the following equation:

$$CalFactor(Ph_2(i)) = \frac{E^2_{TOT,Ph_2(i)} - E^2_{1,0} - E^2_{2,0}}{E_{1,0}E_{2,0}}$$

wherein:

$E_{1,0}$ and $E_{2,0}$ correspond to the first and second set of lobes from the first and second signals;

the first signal has an amplitude (a1) and a phase (ph1);

the second signal has an amplitude (a2) and a phase (ph2);

relative phase ph2 is incremented from 0 to 360 degrees; and $E_{TOT,Ph_2(i)}{}^2$ is the default third set of lobes from the first and second antennas as a function ph2.

In another example embodiment, wherein the new third set of lobes is calculated according to the following equations:

$$E_{TOT,Ph_2(i),j}{}^2 = E_{1,j}{}^2 + E_{2,j}{}^2 + E_{1,j}E_{2,j} \times \mathrm{CalFactor}(Ph_2(i))$$

$$E^2_{TOT,Ph_2(i),j} = E^2_{1,o}\left[\frac{a_{1,j}}{a_1}\right]^2 + E^2_{2,0}\left[\frac{a_{2,j}}{a_2}\right]^2 + E_{1,0}\frac{a_{1,j}}{a_1}E_{2,0}\frac{a_{2,j}}{a_2}xCalFactor(Ph_2(i))$$

wherein the amplitudes and the phases of the first and second signals are: a1$_j$ and a2$_j$ and ph1=0 (ref) and ph2, that maps to a ph2(*i*) in the calibration factor; and wherein j corresponds to the set of first and second signals.

The above discussion is not intended to represent every example embodiment or every implementation within the scope of the current or future Claim sets. The Figures and Detailed Description that follow also exemplify various example embodiments.

Various example embodiments may be more completely understood in consideration of the following Detailed Description in connection with the accompanying Drawings, in which:

Figure 1:
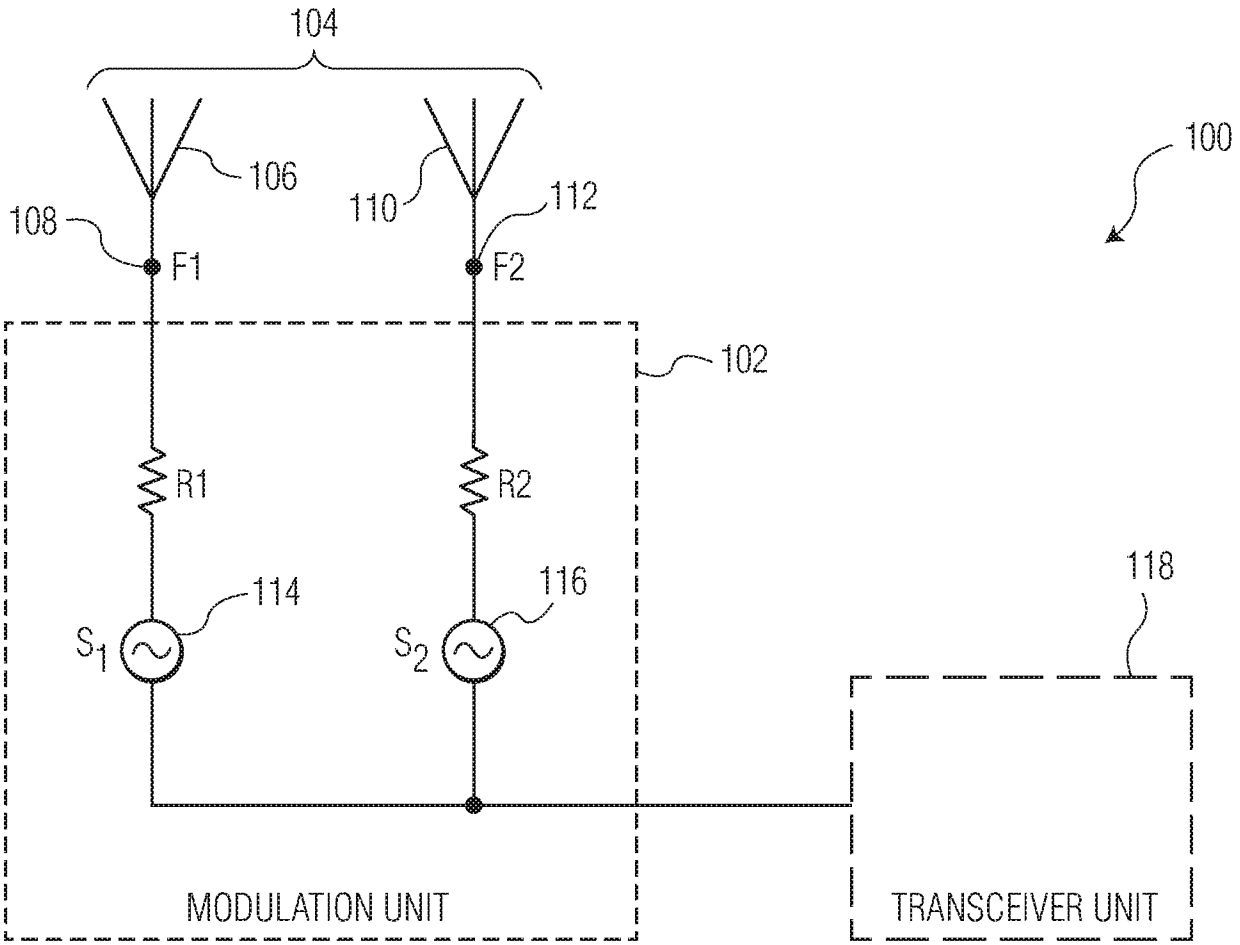
FIG. 1 is an example antenna combination device.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

DETAILED DESCRIPTION

Now discussed is a device configured to transform a set of individual antenna's default radiation patterns into a composite "quasi-omnidirectional" antenna pattern. In various example embodiments an antenna radiation pattern can be in the form of gain [dBi], E-field [dBV/m], or other characterizations of electromagnetic radiation.

"Omnidirectional" antennas have an axis around which electromagnetic (EM) waves are perpendicularly radiated symmetrically. However, along that axis (i.e. parallel to that axis) radiated EM power is zero. Hence, in a plane perpendicular to that axis, the pattern is symmetrical and its standard deviation is zero.

In contrast, a radiation pattern of a "quasi-omnidirectional" antenna would have a non-zero standard deviation. In some of the example embodiments, such as those discussed herein in FIGS. 5 and 6, the resulting quasi-omni directional antenna E-field pattern has a standard deviation of approximately 4 dB.

"Quasi-omnidirectional" antenna patterns are thus herein defined as an antenna pattern having a non-zero standard deviation in a predetermined plane with respect to the antenna's structure. Depending upon an application an acceptable non-zero standard deviation in the predetermined plane may vary.

Thus given a set of networked antennas that either individually have a large number of electromagnetic lobes or when combined have a large number of electromagnetic lobes, are according to the discussion below are reduced in number (e.g. smoothed) such that their combined antenna pattern is more omnidirectional than either the individual and/or combined antennas were. For example, a first antenna having six lobes and a second antenna having four lobes is smoothed into a more omnidirectional antenna having only three lobes. Any residual nulls in the new combined antenna pattern can be dynamically oriented toward interference sources.

Quasi-omnidirectional antenna patterns in many example embodiments include: antenna patterns that exhibit a substantially equal gain, E-field, or directivity in all directions in a plane in which the antenna pattern is defined. Quasi-omnidirectional is herein defined to also include: antenna patterns that exhibit a substantially (i.e. within a predetermined standard deviation) equal gain, E-field, directivity in all directions except for distinct null/attenuation angles where the gain, E-field, directivity, is significantly lower in this plane in which the antenna pattern is defined.

Such a quasi-omnidirectional pattern composite antenna is applicable to a variety of contexts including improving communications and limiting interference for vehicles having diversity antenna systems, wireless earbuds, and other sets of networked antennas.

The individual antenna's default pattern and/or individual antenna's type do not need to be predefined and/or positioned in a specific way. Instead the quasi-omnidirectional composite antenna pattern shaping discussed herein can be applied to any set of networked antennas. Thus out of two antennas that are not at all omnidirectional, a combined pattern that quasi-omnidirectional can be generated.

FIG. 1 is an example antenna combination device 100. The antenna combination device 100 includes a modulation unit 102 (transmit or receive configuration shown), a set of networked antennas 104 (e.g. composite antenna), a first signal 114 (s1) (e.g. transmit and/or receive), a second signal 116 (s2) (e.g. transmit and/or receive), and a transceiver unit 118.

The set of networked antennas 104 includes a first antenna 106 having a feeding port 108 (F1), and a second antenna 110 having a feeding port 112 (F2). The first signal 114 (s1) includes an amplitude (a1) and a phase (ph1). The second signal 116 (s2) includes an amplitude (a2) and a phase (ph2).

The first and second antennas 106, 110 can be of various types and have various physical positions on a vehicle, person, or other structure. While the example embodiments discussed herein include two networked antennas 104, other embodiments can scale to a larger number of networked antennas 104.

The first antenna 106 passes the first signal 114 through feeding port 108 (F1) and the second antenna 110 passes the second signal 116 through feeding port 112 (F2). The first antenna 106 is connected to first signal (s1) 114 and the second antenna 110 is connected to second signal (s2) 116.

First, to begin, a set of individual and combined (i.e. total) antenna patterns are obtained, while the first and second signal's 114, 116 amplitude (a1 and a2) are each kept constant but their relative phase is varied from 0 to 360 degrees, as described in more detail below. In various example embodiments, only a relative (not absolute) phase (ph2-ph1) between the first and second signals 114, 116 need be applied and stored. For example, in various places in the discussion below, ph1=0, and only ph2 is varied.

While the present discussion is for just two antennas (i.e. the first and second antennas 106, 110), the techniques described herein can be extended to sets of networked antennas 104 having more than two antennas.

These set of individual and combined antenna patterns can be obtained either from published literature, simulation, or direct measurement. In some example embodiments using direct measurement, as discussed below, identical antenna input signal (transmit or receive) having a same amplitude and phase are used.

Only one feeding port 108, 112 is driven with one source, first signal 114 (s1) or second signal 116 (s2), at a time. The first signal 114 (s1) is a single frequency signal characterized by amplitude (a1) and phase (ph1) in the time domain. The second signal 116 (s2) is a single frequency signal characterized by amplitude (a2) and phase (ph2) in the time domain.

In some example embodiments, the first signal 114 (s1) and the second signal 116 (s2) are chosen as follows: a1=a2=1 and ph1=ph2=0. Even though the signals 114, 116 are identical, because the antennas 106, 110 are different, two separate antenna patterns are captured.

The antennas 106, 110 patterns can be recorded as either an E-field pattern in dBV/m, an antenna gain pattern in dBi, or a directivity pattern in dBi. Subsequent Figures and the discussion that follows continues with the E-field pattern in dBV/m.

A first set of antenna (i.e. E-field) patterns $E_{1,0}$ and $E_{2,0}$ for a1=a2=1 and ph1=ph2=0 are obtained. Next, the phase of either one of the first and second signals 114, 116 is incremented until a complete set of antenna (i.e. E-field) patterns $E_{TOT,Ph_2(i)}^2$ are obtained for relative phases ranging from 0 to 360 degrees.

Second, to continue, a set of calibration factors are calculated based on the set of individual and combined patterns (i.e. E-field) obtained above. The set of calibration factors (i.e. CalFactors) are calculated from the collected antenna patterns (i.e. E-field), according to a following equation:

$$CalFactor(Ph_2(i)) = \frac{E_{TOT,Ph_2(i)}^2 - E_{1,0}^2 - E_{2,0}^2}{E_{1,0}E_{2,0}}$$

wherein: $E_{1,0}$ and $E_{2,0}$ correspond to the first and second antenna patterns (i.e. E-field) from the first and second signals (114, 116); the first signal has the amplitude (a1) and the phase (ph1); the second signal has the amplitude (a2) and the phase (ph2); relative phase ph2 is incremented from 0 to 360 degrees; and $E_{TOT,Ph_2(i)}^2$ is a total composite E-field pattern from the first and second antennas as a function ph2.

The antenna radiation patterns (e.g. gain, E-field, directivity, etc.) and set of calibration factors and $E_{1,0}$ and $E_{2,0}$ are stored in a calibration matrix (e.g. look-up table) in memory. This data captures the dependency of the combined patterns on amplitude and phase difference between the first and second signals 114, 116.

Third, based on the set of calibration factors and the individual antenna patterns for each individual antenna, a new combined antenna pattern can be generated to either improve reception or transmission of wireless signals by looking up amplitude and phase calibration factors for a desired antenna pattern.

Thus from the set of calibration factors, new predicted total E-field patterns can be subsequently mapped to various other first and second signals 114, 116 (transmit or receive) having various amplitudes and phases as follows:

$$E_{TOT,Ph_2(i),j}^2 = E_{1,j}^2 + E_{2,j}^2 + E_{1,j}E_{2,j} \times \text{CalFactor}(Ph_2(i))$$

$$E_{TOT,Ph_2(i),j}^2 =$$

-continued $$E_{1,o}^2\left[\frac{a_{1,j}}{a_1}\right]^2+E_{2,0}^2\left[\frac{a_{2,j}}{a_2}\right]^2+E_{1,0}\frac{a_{1,j}}{a_1}E_{2,0}\frac{a_{2,j}}{a_2}xCalFactor(Ph_2(i))$$

wherein an amplitude and phase of the first and second signals 114, 116 are: a1$_j$ and a2$_j$ and ph1=0 (ref) and ph2$_j$ that maps to a ph2($i$) in the calibration factor. Index "j" corresponds to the j$^{th}$ iteration in an iterative solver for which a set j of first and second signals result in the j$^{th}$ total E-field pattern $E_{TOT,Ph_2(i),j}{}^2$ Based on the expression above, an iterative solver will converge to the optimal set of first and second signals that provide the desired total E-field pattern.

The modulation unit 102 includes circuits, firmware and/or software configured to identify the first and second signals 114, 116 required to generate the new combined antenna pattern using an iterative optimization algorithm.

The modulation unit 102 launches the iterative solver that identifies a1, a2, ph1 and ph2 using an optimization algorithm to yield a selected new combined antenna pattern. Circuits for actually varying the first and second signals 114, 116 can either be in the modulation unit 102 or the transceiver unit 118. These circuits can include amplitude shifters and phase shifters. In some example embodiments, the iterative solver operates in real-time as the vehicle moves from location to location.

The antenna patterns can be measured, simulated or published in a vertical, horizontal, or any other plane. In some example embodiments, the new combined antenna pattern is selected to boost reception and/or transmission in a particular direction. In other example embodiments, the new combined antenna pattern is selected to attenuate or block interference source signals from a particular direction. In this way the antenna combination device 100 dynamically adapts the set of networked antennas.

A null or significant attenuation (of varying arc widths) of the combined antenna pattern can be radially oriented in a direction of an interference source (e.g. a reflected multipath signal from an FM antenna tower, such as in a city environment).

If an interference source has a fixed location (e.g. a reflecting building, other radio broadcast towers on a same frequency, etc.), then together with a current location of the vehicle, a position and/or angle at which the interferer is located with respect to the vehicle will be known and a null of the combined antenna's E-field pattern can be oriented toward the interference source. GPS, WiFi, Cellular Node, or other techniques can be used to provide this location information.

If the interference source is variable (e.g. a set of moving vehicles passing by each other), then other position location information techniques (e.g. such as a vehicle to vehicle (V2V) or vehicle to everything (V2X) position signal) can be used to dynamically orient one or more nulls in the combined antenna's E-field pattern toward the moving interference source. A "null" is herein defined as an antenna pattern strength that is a predetermined dB below a maximum antenna pattern strength (i.e. the "null" need not truly be zero).

This flexibility of the antenna combination device 100 permits separate antennas within the network of antennas to be designed independently and still be combined to create a desired composite antenna pattern.

Figure 2:
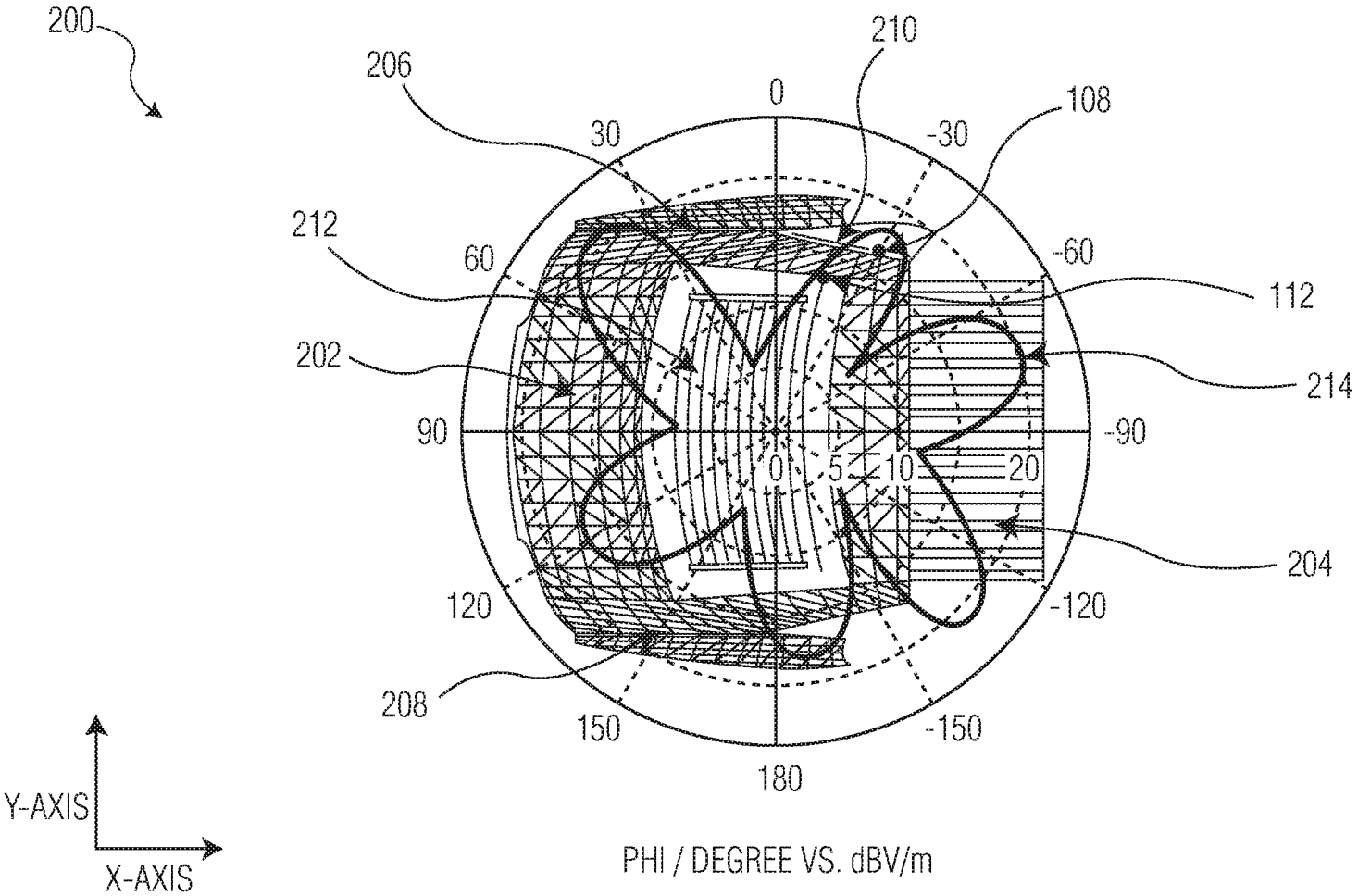
FIG. 2 is an example measured, simulated or published antenna pattern (e.g. first set of lobes) for a first antenna.

FIG. 2 is an example 200 measured, simulated or published antenna pattern (e.g. first set of lobes 214) for the first antenna 106. Simulations can be in one example instance be performed using an industry leading 3-dimensional electromagnetic simulator, such as from CST Microwave studio.

The example 200 first set of six lobes 214 are shown on a vehicle (only rear section of an automobile sedan shown). The vehicle has a trunk 202, a roof 204, a left rear side panel 206, and a right rear side panel 208.

A side window antenna 210 functions as the first antenna 106 with the feeding port 108 (F1). A rear window heating element 212 functions as the second antenna 110 with the feeding port 112 (F2).

The x-y axis, shown in FIG. 2, orients a position of the vehicle, while the radial graph orients the antenna pattern of the first and second 106, 110 antennas. Direct antenna gain, E-field or directivity measurements can be obtained by putting the set of networked antennas 104 in an anechoic room.

The rear window antenna 212 and side window antenna 210 can be tailored for FM and/or DAB frequency bands. The modulation unit 102 can be applied to many different antenna types operating at various frequencies, such as for example, two V2X antenna structures on distant locations on a vehicle roof top operating at 5.9 GHz.

In various other example embodiments, the first antenna 106 can additionally be characterized in other horizontal planes, a vertical plane, or a set of planes, at a specific frequency (e.g. 130 MHz) and where the first signal 114 (s1) has a specific fixed amplitude and phase. The resulting transmit and/or receive antenna pattern (i.e. $E_{1,0}$ E-field) can be in dBV/m.

Figure 3:
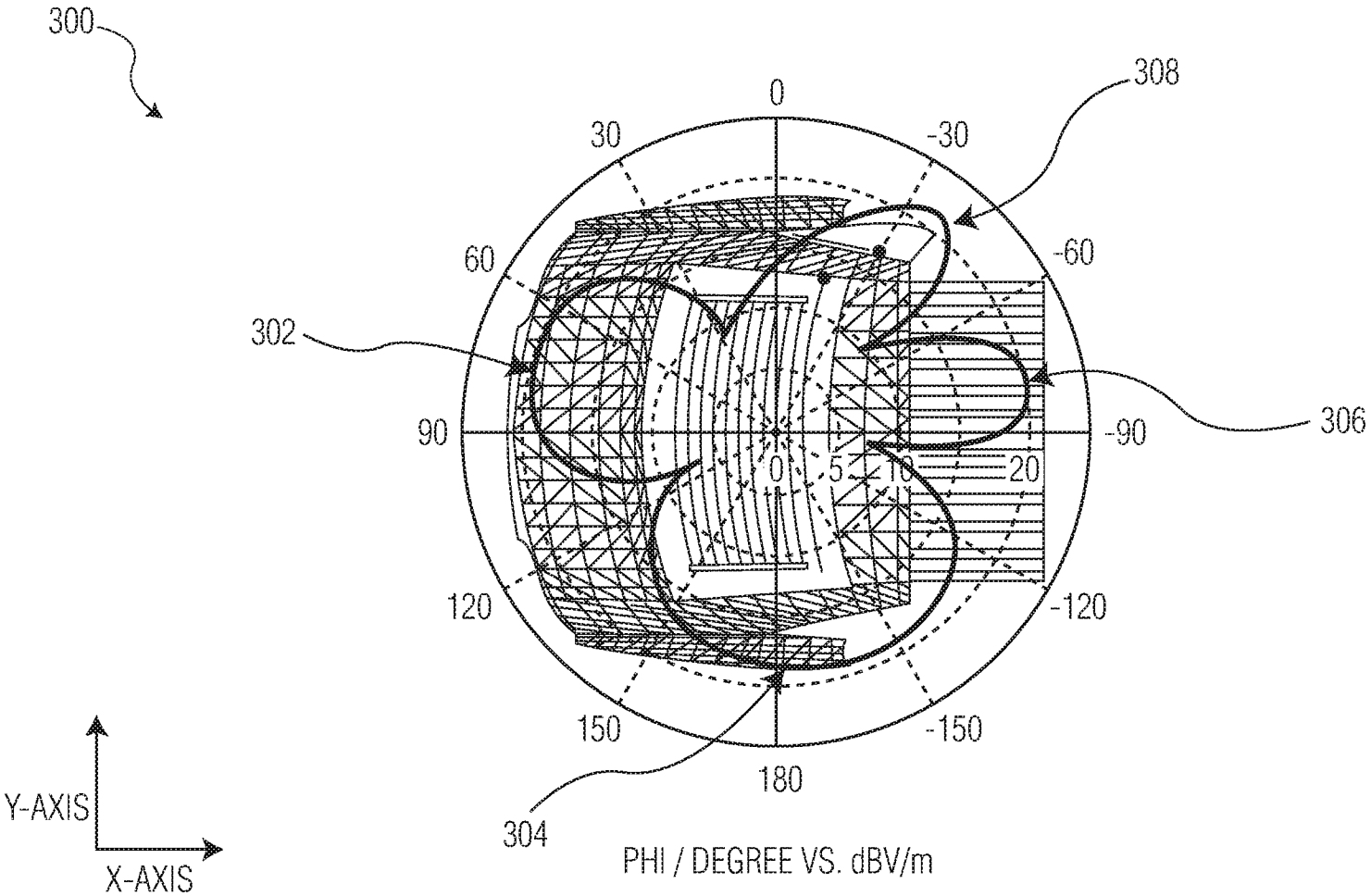
FIG. 3 is an example measured, simulated or published antenna pattern (e.g. second set of lobes) for a second antenna.

FIG. 3 is an example 300 measured, simulated or published antenna pattern (e.g. second set of lobes) for the second antenna 110. The example 300 second set of four electromagnetic field lobes includes a first E-field lobe 302, a second E-field lobe 304, a third E-field lobe 306, and a fourth E-field lobe 308.

Again, in various example embodiments, the second antenna 110 is characterized in a horizontal plane, a vertical plane, or both planes, at a same specific fixed frequency and the second signal 116 (s2) has a same specific fixed amplitude and phase as was used for the first antenna's 106 characterization using the first signal 114 (s1). The resulting transmit and/or receive antenna pattern (i.e. $E_{2,0}$ E-field) can be in dBV/m.

Figure 4:
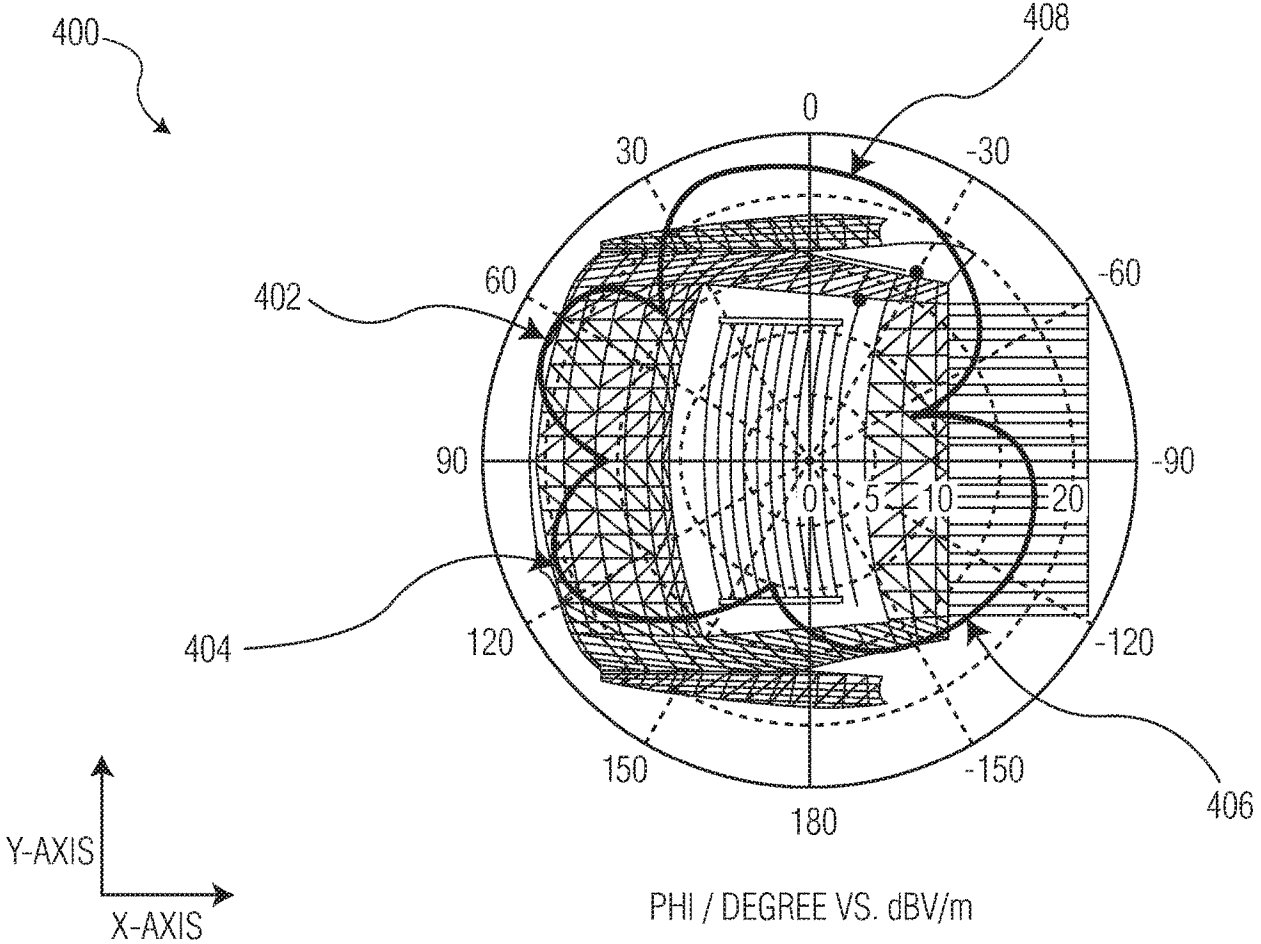
FIG. 4 is an example measured, simulated or published combined antenna pattern (e.g. third set of lobes) of both the first antenna and the second antenna.

FIG. 4 is an example 400 measured, simulated or published combined antenna pattern (e.g. default third set of four lobes) of both the first antenna 106 and the second antenna 110. The example 400 default third set of four E-field lobes includes a first E-field lobe 402, a second E-field lobe 404, a third E-field lobe 406, and a fourth E-field lobe 408.

Both feeding ports 108, 112 of the combined antennas 106, 110 are driven by the same specific fixed frequency and the same amplitude as was used for the first and second antenna's 106, 110 prior characterizations. However, feeding ports 108, 112 of the combined antennas 106, 110 are driven by a different phase as opposed to the first and second antenna's 106, 110 prior characterizations. The resulting combined transmit and/or receive antenna pattern (i.e. $E_{TOT,ph2}$ E-field) can be in dBV/m.

This third set of four lobes is a default antenna pattern without active/dynamic amplitude and phase adjustments by the modulation unit 102. From $E_{1,0}$, $E_{2,0}$, and $E_{TOT,ph2(i)}$ the calibration factors (i.e. CalFactor($Ph_2$(i))) are determined as discussed above, and stored in a calibration matrix.

Figure 5:
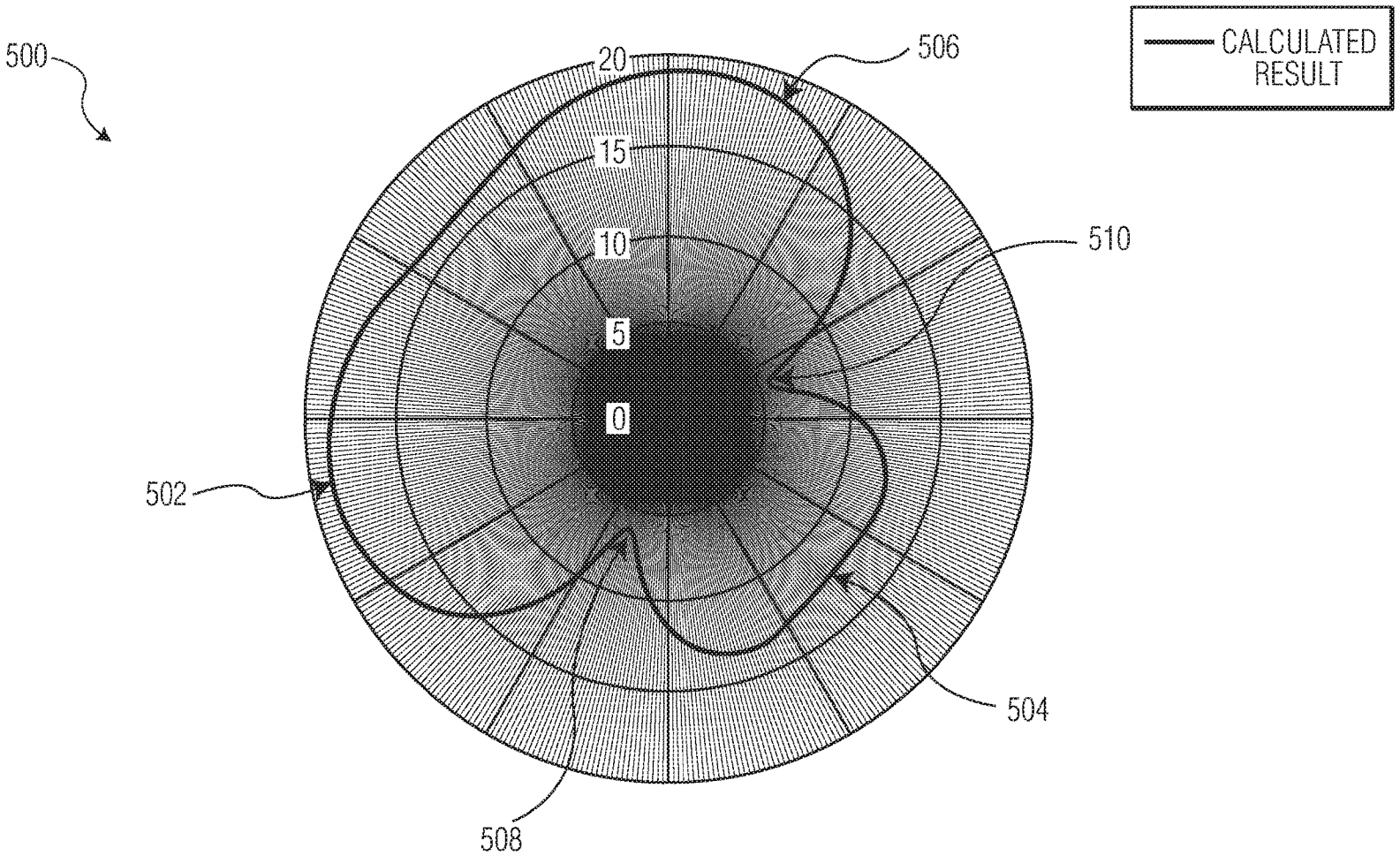
FIG. 5 is an example calculated combined antenna pattern (e.g. different third set of lobes) of both the first antenna and the second antenna but with a different amplitude and/or phase angle than was used originally to characterize the first and second antennas.

FIG. 5 is an example 500 calculated combined new desired antenna pattern (e.g. a new third set of three lobes) of both the first antenna 106 and the second antenna 110 with new amplitudes but the phase angles that were used originally to determine the combined antenna patterns of both the first antenna 106 and the second antenna 110 retrieved from the calibration matrix. One example of the calibration matrix phase angles is as shown in FIG. 4.

The example 500 calculated new third set of three lobes includes a first E-field lobe 502, a second E-field lobe 504, a third E-field lobe 506, a first null 508, and a second null 510.

This new third set of three lobes is a calculated antenna pattern which can be generated in real-time to actively and dynamically adapt to changes in desired signal sources and/or interference signal sources, by using the modulation unit 102 to vary amplitude and phase based on the calibration factors stored in the calibration matrix.

In this calculation, the feeding ports 108, 112 of the combined antennas 106, 110 are not actually driven by the first and second signals 114, 116 here, but rather the first and second signals 114, 116 are input variables to the $E_{TOT,Ph_2(i),j}^2$ iterative solver calculations performed by the modulation unit 102.

Figure 6:
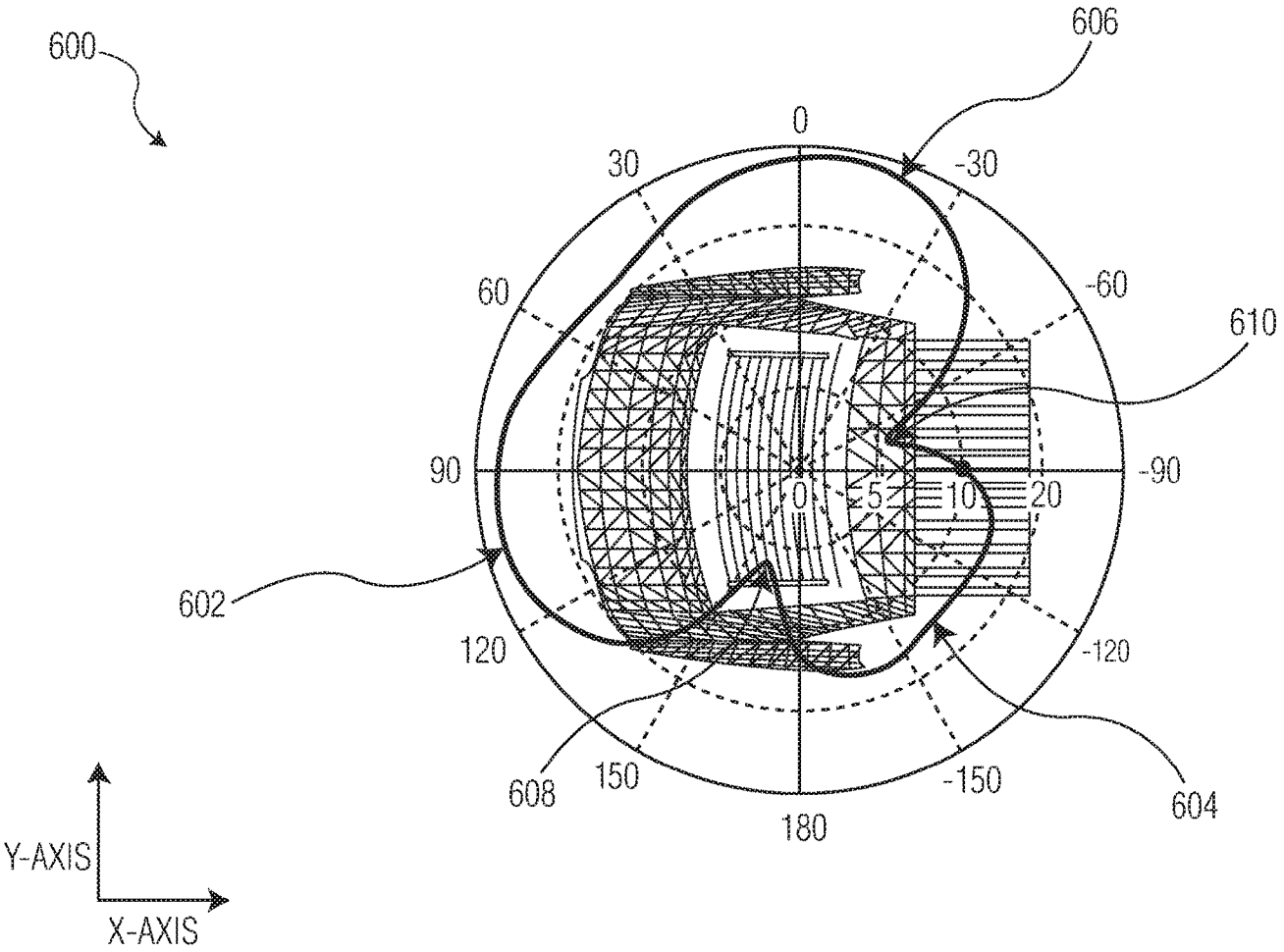
FIG. 6 is an example simulated combined antenna pattern (e.g. the different third set of lobes) of both the first antenna and the second antenna with the same amplitude and/or phase angle that was used for the FIG. 5 calculations.

FIG. 6 is an example 600 simulated combined antenna E-field pattern (e.g. the new third set of three lobes) of both the first antenna 106 and the second antenna 110 with the same amplitude and/or phase angle that was used for the FIG. 5 calculations. The example 600 simulated or measured new third set of three lobes includes a first E-field lobe 602, a second E-field lobe 604, a third E-field lobe 606, a first null 608, and a second null 610.

Figure 7:
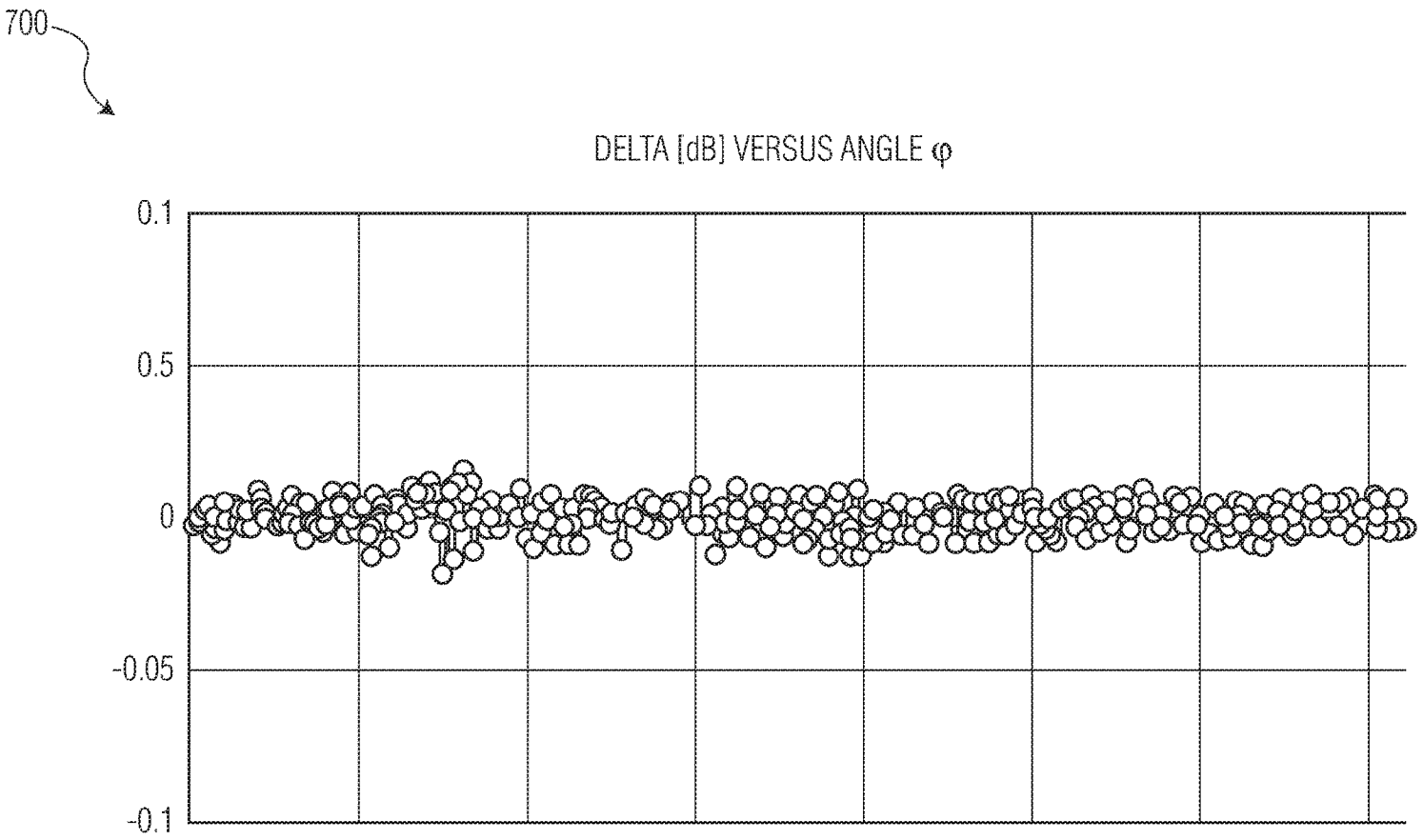
FIG. 7 is an example deviation error between the calculated and simulated combined antenna patterns of FIG. 5 and FIG. 6.

FIG. 7 is an example 700 deviation error between the calculated and simulated combined antenna E-field patterns of FIG. 5 and FIG. 6 that shows how accurate the iterative problem solver calculations can be. The deviation error is shown in dB for relative phases varying from 0 to 360 degrees ($\phi$) between the calculated new third set of three E-field lobes 500 and the simulated or measured new third set of three E-field lobes 600 of the combined antenna for a given first and second signal 114, 116 having specific amplitude and phase angle.

Figure 8:
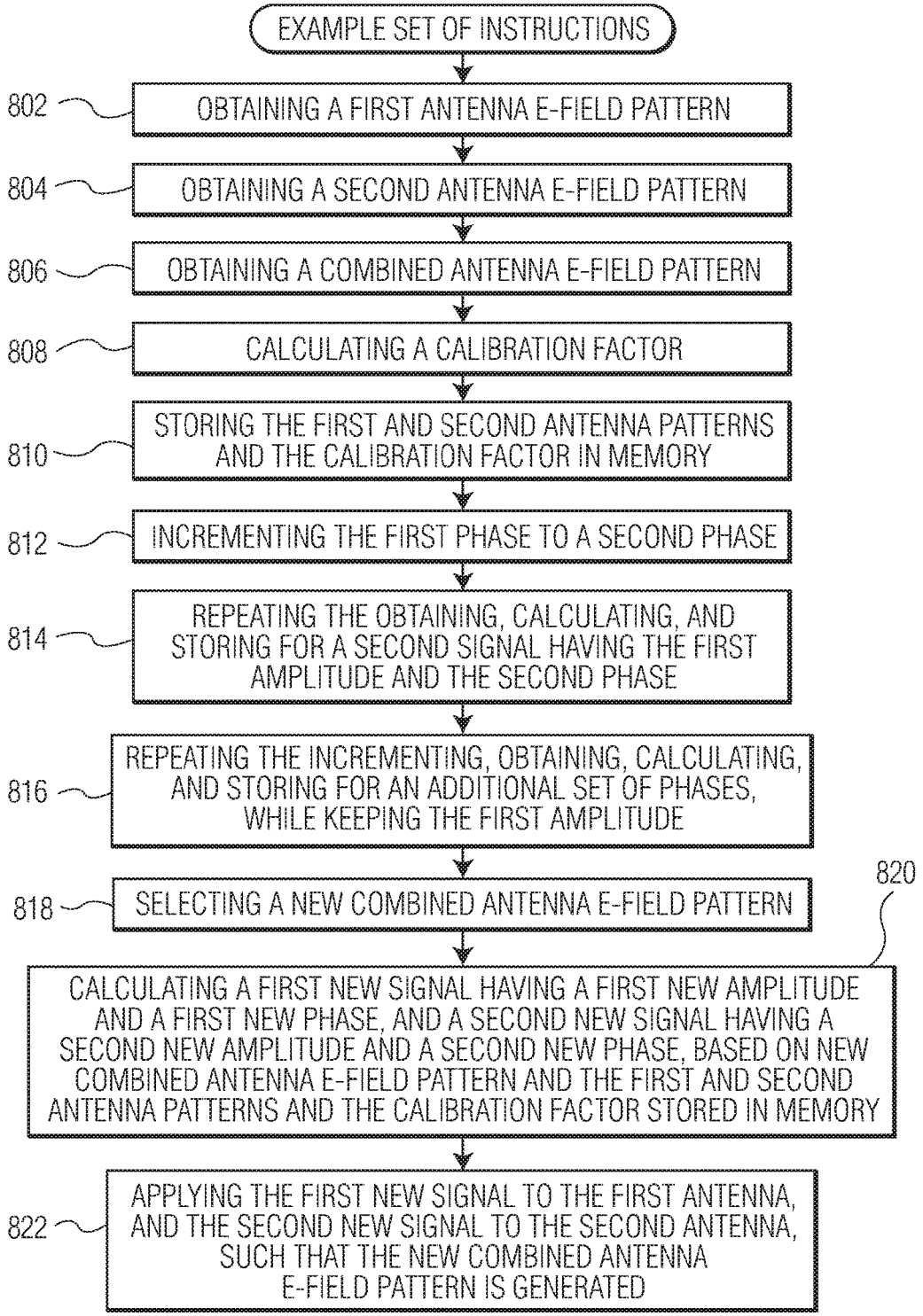
FIG. 8 is an example set of instructions for enabling the antenna combination device.

FIG. 8 is an example set of instructions for enabling the antenna combination device 100. The order in which the instructions are discussed does not limit the order in which other example embodiments implement the instructions unless otherwise specifically stated. Additionally, in some embodiments the instructions are implemented concurrently.

A first set of example instructions for calibration begins in 802, by obtaining (e.g. measuring, simulating, retrieving) a first antenna pattern (e.g. first set of E-field lobes) for a first antenna driven by a first signal having a first amplitude and a first phase. Next in step 804, obtaining a second antenna pattern (e.g. second set of E-field lobes) for a second antenna driven by the first signal having the first amplitude and the first phase.

In step 806, obtaining a combined (i.e. total) antenna E-field pattern (e.g. third set of E-field lobes) for both the first antenna and the second antenna driven by the first signal having the first amplitude and the first phase. Then in step 808, calculating a calibration factor based on the first antenna E-field pattern, the second antenna E-field pattern, and the combined antenna E-field pattern for the first signal having the first amplitude and the first phase.

In step 810, storing the first and second antenna patterns and the calibration factor in memory. In step 812, incrementing the first phase to a second phase.

Then in step 814, repeating the obtaining of a combined antenna pattern, calculating, and storing for a second signal having the first amplitude and the second phase. And in step 816, repeating the incrementing, obtaining, calculating, and storing for an additional set of phases, while keeping the first amplitude.

A second set of example instructions for operation of the antenna combination device 100 begins in 818, by selecting a new combined antenna pattern. In step 820, calculating a first new signal having a first new amplitude and a first new phase, and a second new signal having a second new amplitude and a second new phase, based on new combined antenna pattern and the first and second antenna patterns and the calibration factor stored in memory. Then in step 822, applying the first new signal to the first antenna, and the second new signal to the second antenna, such that the new combined antenna pattern is generated.

Figure 9:
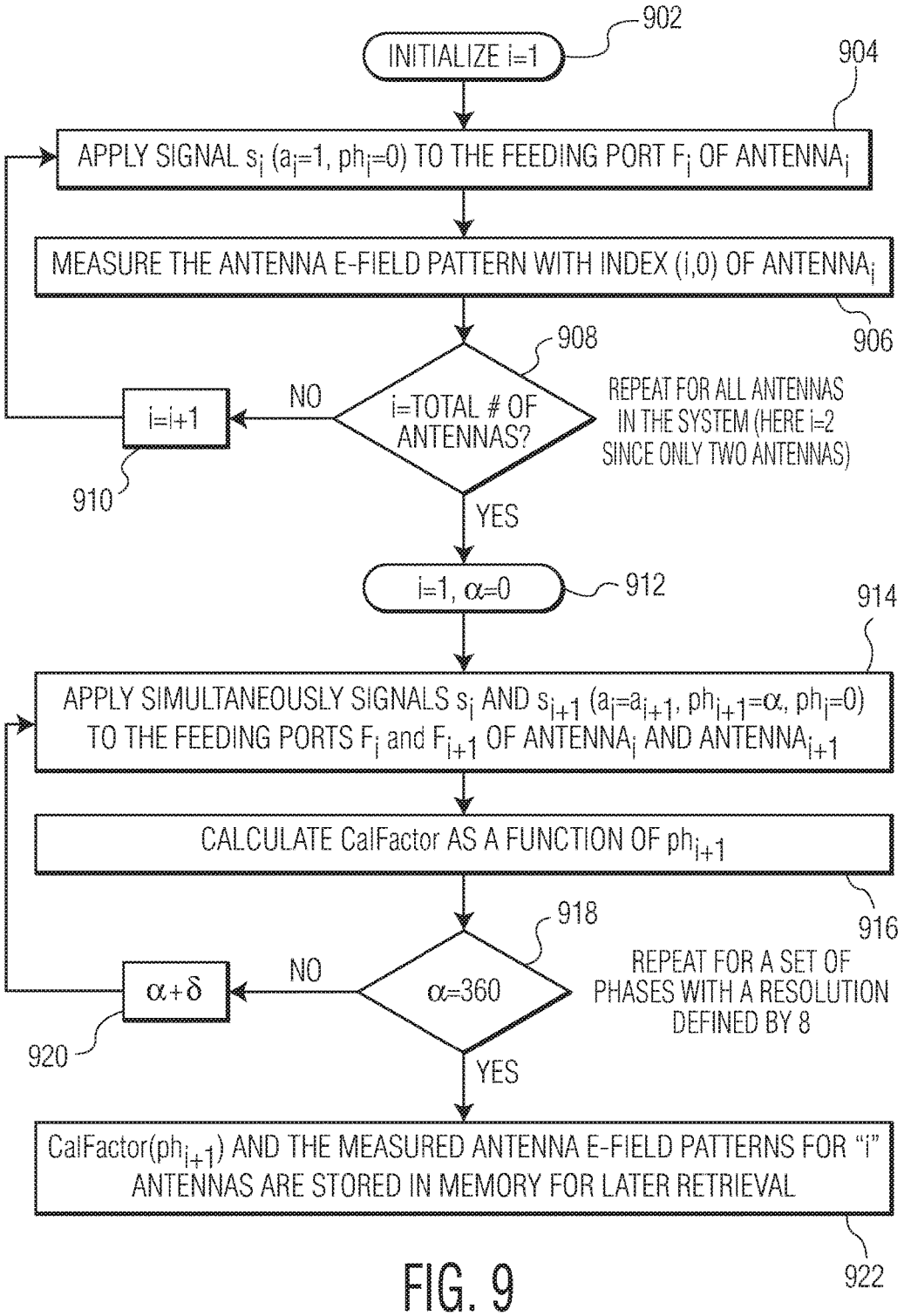
FIG. 9 is an example set of instructions for calibrating the antenna combination device.

FIG. 9 is an example second set of instructions for calibrating the antenna combination device.

A calibration procedure for a two-antenna setup for a single frequency of the first and second signals, for a given polarization and a given angle $\theta$, is now discussed. This calibration procedure can be extended to more than two antennas and for additional frequencies, polarizations and angles $\theta$. By decreasing $\delta$, a granularity of the combined antenna's phase relationship can be increased.

Note, a plane electromagnetic (EM) wave is characterized by electric and magnetic fields traveling in a single direction. In this case, the electric field and the magnetic field are perpendicular to each other and to the direction the plane wave is propagating. Polarization is the figure that the E-field traces out while propagating. If an E-field stays along a single line, this field would be said to be linearly polarized. Special cases thereof are vertically and horizontally polarized fields. If the E-field rotates in a circle, this type of field is described as a circularly polarized wave. If the E-field rotates in an ellipse, this type of field is described as a elliptically polarized wave. One can apply the invention to any polarization. Suppose an antenna supports vertically polarized fields, then the method can be applied in such plane where the radiation pattern exhibits this polarization.

A second set of example instructions for calibration begins in 902, by initializing i=1; in 904 Apply signal si (ai=1, phi=0) to the feeding port Fi of antennai; in 906 Measure the antenna E-field pattern with index (i,0) of antennai; in 908 i=total # of antennas? (i.e. Repeat for all antennas in the system (here i=2 since only two antennas)); in 910 i=i+1; in 912 i=1, $\alpha$=0; in 914 Apply simultaneously signals si and si+1 (ai=ai+1=1, phi+1=$\alpha$, phi=0) to the feeding ports Fi and Fi+1 of antennai and antennai+1; in 916 Calculate CalFactor as a function of phi+1; in 918 $\alpha$=360? (i.e. Repeat for a set of phases with a resolution defined by $\delta$); in 920 $\alpha+\delta$; and in 922 CalFactor(phi+1) and the measured antenna E-field patterns for "i" antennas are stored in memory for later retrieval.

Since the calibration factors of used by the antenna combination device 100 permit a wide variety of antennas to be combined into a quasi-omnidirectional antenna pattern, the individual antennas can be selected for various use cases based, not on their default antenna pattern, but on other factors such as aesthetics, space constraints, manufacturing ease, etc. Thus individual antennas can be random and do not need to be optimized for combining.

In some example embodiments, antennas can even be combined between a set of networked wireless devices (e.g. smartphones) to enhance signal reception for all the networked devices (e.g. FM radio reception inside a building).

In some example earbud embodiments (e.g. earbuds using Bluetooth Low Energy) the antenna combination device 100 can create specific radiation patterns using an antenna in each earbud, such as either a quasi-omnidirectional pattern or directional pattern around a user's head depending on various operational modes of various use cases.

In some example vehicle embodiments (e.g. Vehicle-to-Anything (V2X) and Vehicle-to-Infrastructure (V2I) communication), the antenna combination device 100 can create a various different radiation patterns in real-time using existing vehicle diversity antenna installations to either improve reception and/or attenuate multiple interference sources (e.g. external jammer) using any nulls in the composite antenna's E-field.

When two (or more) V2X antennas are in transmit, the method is also useful when supposing that one wants to create a quasi-omnidirectional pattern for two vehicular antennas that were independently designed by optimizing their first and second signals.

Also in the field of broadcast reception by multiple antennas on a vehicle (e.g. whip antennas, window antennas), the combined radiation pattern of these antennas can give rise to a pattern in receive that is not subject to a harmful jammer positioned a certain angle relative to the vehicle.

Also, given multiple and varying wireless communication signals that pop up near a user with a BLE hearable/wearable and/or around a vehicle, having a method to counter interfering links as they arise along a user's path or a vehicle's trajectory is useful.

The instructions and/or flowchart steps in the above Figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions described above are implemented as functional and software instructions. In other embodiments, the instructions can be implemented either using logic gates, application specific chips, firmware, as well as other hardware forms.

When the instructions are embodied as a set of executable instructions in a non-transient computer-readable or computer-usable media which are effected on a computer or machine programmed with and controlled by said executable instructions. Said instructions are loaded for execution on a processor (such as one or more CPUs). Said processor includes microprocessors, microcontrollers, processor modules or subsystems (including one or more microprocessors or microcontrollers), or other control or computing devices. A processor can refer to a single component or to plural components. Said computer-readable or computer-usable storage medium or media is (are) considered to be part of an article (or article of manufacture). An article or article of manufacture can refer to any manufactured single component or multiple components. The non-transient machine or computer-usable media or mediums as defined herein excludes signals, but such media or mediums may be capable of receiving and processing information from signals and/or other transient mediums.

Various systems, such as the antenna combination device 100 discussed above, can host these instructions. Such systems can include an input/output data interface, a processor, a storage device, and a non-transient machine-readable storage medium. The machine-readable storage medium includes the instructions which control how the processor receives input data and transforms the input data into output data, using data within the storage device. The machine-readable storage medium in an alternate example embodiment is a non-transient computer-readable storage medium. In other example embodiments the set of instructions described above can be implemented either using logic gates, application specific chips, firmware, as well as other hardware forms.

The processor (such as a central processing unit, CPU, microprocessor, application-specific integrated circuit (ASIC), etc.) controls the overall operation of the storage device (such as random access memory (RAM) for temporary data storage, read only memory (ROM) for permanent data storage, firmware, flash memory, external and internal hard-disk drives, and the like). The processor device communicates with the storage device and non-transient machine-readable storage medium using a bus and performs operations and tasks that implement one or more instructions stored in the machine-readable storage medium. The machine-readable storage medium in an alternate example embodiment is a computer-readable storage medium.

It will be readily understood that the components of the embodiments as generally described herein and illustrated in the appended figures could be arranged and designed in a wide variety of different configurations. Thus, the detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

What is claimed is:

1. An antenna combination device, comprising:

a modulation unit;

wherein the modulation unit is configured to be coupled to:

a first antenna, having a first set of electromagnetic field lobes and configured to pass a first signal;

a second antenna, having a second set of electromagnetic field lobes and configured to pass a second signal;

wherein the modulation unit is configured to vary the first signal and the second signal, resulting in a third set of electromagnetic field lobes from a combination of the first and second sets of electromagnetic field lobes;

wherein the first, second and third electromagnetic field lobes are in a same plane; and wherein a number of the third set of lobes is less than or equal to either a number of the first set of lobes or a number of the second set of lobes.

2. The device of claim 1:

wherein at least one of the respective first and second sets of lobes of the first and second antennas is not an omnidirectional lobe.

3. The device of claim 1:

wherein the third set of lobes are distributed over at least 180 arc degrees.

4. The device of claim 1:

wherein the third set of lobes are distributed over at least 270 arc degrees.

5. The device of claim 1:

wherein the third set of lobes includes a null;

wherein the modulation unit is configured to identify an interference source; and wherein the modulation unit is configured to select the first signal and the second signal, such that the null is oriented toward the interference source.

6. The device of claim 5:

wherein the modulation unit is configured to receive information corresponding to a location of the interference source and a current location of the set of networked antennas; and wherein the modulation unit is configured to pre-orient the null toward the interference source before signals from the interference source are detected by the modulation unit.

7. The device of claim 1:

wherein the third set of lobes has a quasi-omnidirectional composite antenna pattern.

8. The device of claim 1:

wherein the third set of lobes has a composite antenna pattern in the plane that differs from an omnidirectional antenna pattern by a predetermined standard deviation.

9. The device of claim 8:

wherein the standard deviation is at least 4 dB.

10. The device of claim 1:

wherein the antenna combination device is embedded in at least one of: a vehicle, a pair of earbuds, or a smartphone.

11. The device of claim 1:

wherein the first and second antennas are V2X antennas on a vehicle;

wherein the first antenna is a directional antenna oriented toward a front of the vehicle; and wherein the second antenna is a directional antenna oriented toward a back of the vehicle.

12. The device of claim 1:

wherein the first signal of the first antennal includes a first amplitude and a first phase;

wherein the second signal of the second antennal includes a second amplitude and a second phase; and wherein the modulation unit includes:

an amplitude modulation unit; and a phase modulation unit;

wherein the amplitude and phase modulation units are configured to be coupled to the first and second antennas;

wherein the amplitude modulation unit is configured to vary a difference between the first amplitude of the first signal and the second amplitude of the second signal; and wherein the phase modulation unit is configured to vary a difference between the first phase of the first signal and the second phase of the second signal.

13. The device of claim 12:

wherein the modulation unit is configured to obtain a set of individual and combined antenna E-field patterns for the first and second antennas; and wherein the first and second amplitudes are kept equal as a difference between the first and second phase is varied from 0 to 360 degrees.

14. The device of claim 13:

wherein the modulation unit is configured to obtain a set of calibration factors based on the set of individual and combined E-field patterns.

15. The device of claim 14:

wherein the modulation unit is configured to generate a new combined antenna E-field pattern based on the set of calibration factors and the individual antenna E-field patterns.

16. The device of claim 1, further comprising:

the first antenna and the second antenna coupled to the modulation unit; and a transceiver coupled to the modulation unit;

wherein the transceiver includes transmitter and/or receiver circuitry for generating and/or receiving the first and second signals.

17. An article of manufacture including at least one non-transitory, tangible machine readable storage medium containing executable machine instructions for antenna combination when executed by a processor, comprising:

wherein the article includes, a modulation unit configured to be coupled to a first antenna and a second antenna;

wherein the first antenna, includes a first set of lobes and is configured to pass a first signal;

wherein the second antenna, includes a second set of lobes and is configured to pass a second signal; and wherein the instructions include, selecting a new third set of lobes;

wherein a number of the third set of lobes is less than or equal to either a number of the first set of lobes or a number of the second set of lobes;

calculating a first new signal having a first new amplitude and a first new phase, and a second new signal having a second new amplitude and a second new phase, based on the new third set of lobes, a first and second set of lobes, and a calibration factor stored in memory;

applying the first new signal to the first antenna, and the second new signal to the second antenna, such that the new third set of lobes is generated.

18. The article of claim 17, wherein the calibration factors were previously calculated by:

obtaining the first set of lobes by driving the first antenna by the first signal having a first amplitude and a first phase;

obtaining the second set of lobes by driving the second antenna by the first signal having the first amplitude and the first phase;

obtaining a default third set of lobes by driving both the first antenna and the second antenna by the first signal having the first amplitude and the first phase;

calculating a calibration factor based on the first set of lobes, the second set of lobes, and the default third set of lobes;

storing the first and second antenna patterns and the calibration factor in memory;

incrementing the first phase to a second phase;

repeating the obtaining, calculating, and storing for a second signal having the first amplitude and the second phase; and repeating the incrementing, obtaining, calculating, and storing for an additional set of phases, while keeping the first amplitude.

19. The article of claim 17, wherein the calibration factors were previously calculated according to the following equation:

$$CalFactor(Ph_2(i)) = \frac{E^2_{TOT,Ph_2(i)} - E^2_{1,0} - E^2_{2,0}}{E_{1,0}E_{2,0}}$$

wherein:

$E_{1,0}$ and $E_{2,0}$ correspond to the first and second set of lobes from the first and second signals;

the first signal has an amplitude (a1) and a phase (ph1);

the second signal has an amplitude (a2) and a phase (ph2);

relative phase ph2 is incremented from 0 to 360 degrees; and $E_{TOT,Ph_2(i)}{}^2$ is the default third set of lobes from the first and second antennas as a function ph2.

20. The article of claim 17, wherein the new third set of lobes is calculated according to the following equations:

$$E_{TOT,Ph_2(i),j}{}^2 = E_{1,j}{}^2 + E_{2,j}{}^2 + E_{1,j}E_{2,j} \times \mathrm{CalFactor}(Ph_2(i))$$

$$E^2_{TOT,Ph_2(i),j} = E^2_{1,o}\left[\frac{a_{1,j}}{a_1}\right]^2 + E^2_{2,0}\left[\frac{a_{2,j}}{a_2}\right]^2 + E_{1,0}\frac{a_{1,j}}{a_1}E_{2,0}\frac{a_{2,j}}{a_2}xCalFactor(Ph_2(i))$$

wherein the amplitudes and the phases of the first and second signals are: a1$_j$ and a2$_j$ and ph1=0 (ref) and ph2, that maps to a ph2($i$) in the calibration factor; and wherein j corresponds to the set of first and second signals.

* * * * *